US006530168B2

(12) United States Patent
Shimi et al.

(10) Patent No.: US 6,530,168 B2
(45) Date of Patent: Mar. 11, 2003

(54) SAFETY MECHANISM FOR A HANDGUN

(75) Inventors: Eitan Shimi, Herzlia (IL); Ilan Faiga, Ashdod (IL); Ital Kilshon, Givatayim (IL)

(73) Assignee: Israel Military Industries Ltd. (IL)

( * ) Notice: Subject to any disclaimer, the term of this patent is extended or adjusted under 35 U.S.C. 154(b) by 0 days.

(21) Appl. No.: 09/848,222

(22) Filed: May 3, 2001

(65) Prior Publication Data

US 2002/0162264 A1 Nov. 7, 2002

(51) Int. Cl.[7] ..... F41A 17/00
(52) U.S. Cl. ..... 42/70.08; 42/70.11
(58) Field of Search ..... 42/70.08, 70.01, 42/66; 70/63

(56) References Cited

U.S. PATENT DOCUMENTS

| | | | | | |
|---|---|---|---|---|---|
| 3,601,918 | A | | 8/1971 | Keppeler et al. | 42/70 |
| 3,762,089 | A | * | 10/1973 | Meyer, Jr. | 42/106 |
| 3,838,533 | A | | 10/1974 | Ruger | 42/70 |
| 3,942,278 | A | * | 3/1976 | Schaller et al. | 42/70.08 |
| 4,021,955 | A | * | 5/1977 | Curtis | 42/70.08 |
| 4,090,316 | A | * | 5/1978 | Volkmar | 42/70.08 |
| 4,208,947 | A | | 6/1980 | Hillberg | 89/148 |
| 4,555,861 | A | * | 12/1985 | Khoury | 42/69.01 |
| 4,658,529 | A | | 4/1987 | Bertolini | 42/70.08 |
| 5,245,776 | A | * | 9/1993 | Dornaus | 42/144 |
| 5,625,971 | A | * | 5/1997 | Tuma et al. | 42/70.01 |
| 6,145,234 | A | | 11/2000 | Fluhr | 42/70.08 |
| 6,173,518 | B1 | | 1/2001 | Oberst | 42/70.06 |

FOREIGN PATENT DOCUMENTS

| | | | | |
|---|---|---|---|---|
| CH | 0338381 | * | 6/1959 | |
| DE | 00304280 A1 | * | 3/1920 | 42/70.08 |
| DE | 319321 | * | 3/1920 | 42/70.08 |
| DE | 0386982 | * | 12/1923 | 42/70.08 |
| DE | 000200967 A1 | * | 12/1958 | 42/70.08 |

* cited by examiner

*Primary Examiner*—Michael J. Carone
*Assistant Examiner*—Denise J Buckley
(74) *Attorney, Agent, or Firm*—Cook, Alex, McFarron, Manzo, Cummings & Mehler, Ltd.

(57) ABSTRACT

A safety mechanism for a handgun having a pivotal hammer arranged to activate a firing pin, the mechanism including a locking element for engaging the firing pin and preventing its movement, and a separate release element for releasing the locking element, the release element being releasable upon being hit by the hammer with a force above a predetermined threshold.

13 Claims, 2 Drawing Sheets

SAFETY MECHANISM FOR A HANDGUN

FIELD OF THE INVENTION

The present invention relates to firearms, in general and, in particular, to a safety mechanism for preventing inadvertent firing of a firearm, particularly a handgun.

BACKGROUND OF THE INVENTION

Firearms of various designs have long been known. One type of firearm has a mechanically activating primer. The energy needed to activate the primer is relatively low. Thus, these firearms suffer from a major disadvantage in that, if the firearm is dropped on the muzzle, the firing pin can move forward with sufficient energy to actuate the primer.

There is shown in U.S. Pat. No. 4,208,947 a safety mechanism for a firearm including a hammer block engageable with the hammer to prevent the hammer from moving into engagement with the firing pin. The hammer block is manually shifted between its active and inactive positions through a safety cam having a positive driving connection with the block. As the cam is moved to shift the block from its non-blocking to its blocking position, the cam also engages the sear to release the sear from the trigger and to allow the hammer to move from its cocked position into a safety position in engagement with the hammer block. This safety mechanism is relatively complicated to manufacture and maintain.

There is known, from U.S. Pat. No. 6,145,234 to Fluhr, a firing pin safety catch mechanism including a one-piece leaf spring extending the length of the breechblock of the firearm, the spring comprising a spring arm, a safety catch and a beveled release part. The safety catch has a first position, wherein the safety catch engages a catch surface of a firing pin, to secure the firing pin in a rest position, and a second position, wherein the safety catch disengages the catch surface, to release the firing pin for movement out of the rest position. The release part acts as a camming surface acting together with the hammer to release the spring.

Another firing pin safety catch mechanism is shown in U.S. Pat. No. 4,658,529 to Bertolini. This mechanism includes an inertial firing pin with an annular groove. The safety is provided with a rib canted toward the hammer side of the firing pin. When the safety is moved to an "on" position, the rib enters the firing pin groove and cams the firing pin so as to retract and lock the pin in a sheathed position within the piston slide.

Yet another firing pin safety device is shown in U.S. Pat. No. 4,090,316 to Volkmar. This patent discloses a firing pin which is pivotable between safety and firing positions, and a hammer which has a striking surface engaging the firing pin when the firing pin is in its firing position, and recess which receives the firing pin when in its safety position.

All of these patents discloses safety devices wherein the firing pin lock is releases directly by the hammer, i.e., the lock and release are a single element.

Accordingly, there is a long felt need for a safety mechanism for a firearm which will prevent inadvertent firing if the handgun receives a shock, by preventing the hammer from inadvertently activating the firing pin, and which is simple to manufacture and actuate, and which includes a safety mechanism to prevent inadvertent release of the firing pin lock.

SUMMARY OF THE INVENTION

The present invention provides a safety mechanism for a handgun having a pivotal hammer arranged to activate a firing pin, the mechanism including a locking element for engaging the firing pin and preventing its movement, and a separate release element for releasing the locking element, the release element being releasable upon being hit by the hammer with a force above a pre-determined threshold.

According to one embodiment of the invention, the locking element includes a firing pin plate through which one end of the firing pin passes, a blocking spring in the firing pin plate, a notch in the firing pin, the blocking spring engaging the notch in a locked orientation, and the blocking spring being out of engagement with the notch in a firing orientation, and a release element for causing the blocking spring to move from the locked orientation to the firing orientation.

According to a preferred embodiment, the blocking spring is mounted in a groove cut in the firing pin plate, and held in the locked orientation by a plunger, the plunger being located so as to be hit by the hammer before the hammer hits the end of the firing pin.

Preferably, the plunger has a conical cross section, the blocking spring being located so as to slide along the plunger when moving from the locked to the unlocked orientation.

Most preferably, the hammer is arranged to hit both the plunger and the firing pin, the hitting of the plunger causing release of the blocking spring so that the firing pin is in the firing orientation.

There is also provided, in accordance with the present invention, a method for preventing inadvertent firing of a firearm having a firing pin seated in a firing pin block and a hammer for actuating the firing pin, the method including mounting a locking element in the firing pin block, mounting a separate release element, coupled to the locking element, in the firing pin block, and releasably engaging the firing pin by the locking element, the locking element being released upon being hit by the hammer with a force above a pre-determined threshold.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a safety mechanism for handguns having a spring biased pivotal hammer for actuating its firing pin. The safety mechanism includes a mechanical locking element for retaining the firing pin, and a release element for releasing the locking element, the release element releasing the locking element upon engagement by the hammer with sufficient force to fire the handgun.

By way of example, the safety mechanism of this invention is suitable for use with a DESERT EAGLE® pistol. The mechanism is particularly well adapted to such a firearm, which is large enough to accommodate the safety device of the present invention. However, it should be understood that the invention is not limited to this particular firearm, but may instead be used with many other types of firearms.

Figure 1:
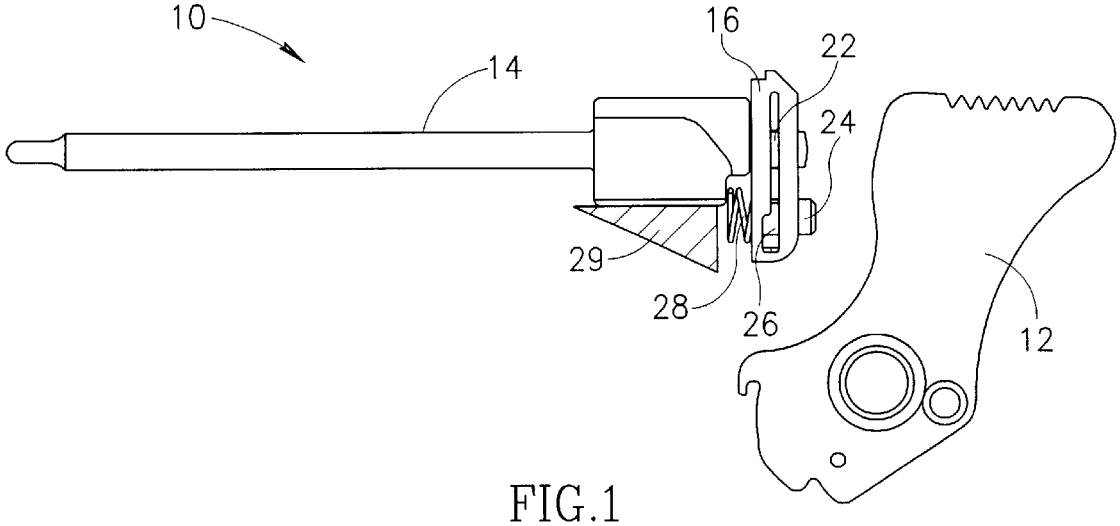
FIG. 1 is schematic side view of a firing pin block as a safety mechanism for a firearm constructed and operative in accordance with one embodiment of the present invention.

Referring now to FIG. 1, there is shown a schematic side view of a firing pin block 10, constructed and operative in accordance with one embodiment of the present invention, which acts as a safety mechanism for a firearm. Firing pin block 10 acts together with the hammer 12 of the firearm which, as known, is arranged to hit one end of a firing pin 14, so as to cause the firing pin, in turn, to activate a primer in the firearm. The end of firing pin 14 is held in a firing pin plate 16, which holds it at the proper orientation for firing by the hammer.

Firing pin block 10 includes a groove 20 in firing pin plate 16, in which is seated a blocking spring 22, held in place by a retaining pin 26. Blocking spring 22 is arranged to releasably engage a groove in the firing pin 14, as described below. A reciprocating plunger 24 is mounted in firing pin plate in contact with blocking spring 22, and is designed to move the blocking spring from a locked orientation to an unlocked orientation. In the locked orientation, the groove of the firing pin is engaged by the blocking spring, so the firing pin cannot move forward to actuate the primer when the firearm falls. When the plunger is pushed by the released hammer, the blocking spring moves to a firing orientation, out of engagement with the firing pin, enabling the firing pin to move to activate the primer when hit by the hammer.

A plunger spring 28 or other return element is provided in the firearm to return the blocking spring to the locking orientation after firing, as described below. The plunger spring can be any suitable spring which is disposed so as to be compressed by the plunger during firing and to return the plunger when released. One suitable arrangement is shown in FIG. 1, where plunger spring 28 is seated in a recess 29 formed between a slide and the plunger in firing pin plate 16. In addition, the plunger spring does not permit the plunger to move (and release the firing pin) below a pre-defined threshold force, thereby preventing inadvertent release of the firing pin and inadvertent firing of the firearm.

Figure 2:
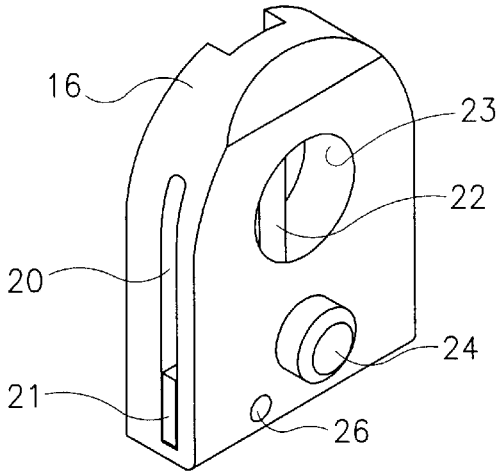
FIG. 2 is a perspective illustration of a firing pin plate in the safety mechanism of FIG. 1.
Figure 3:
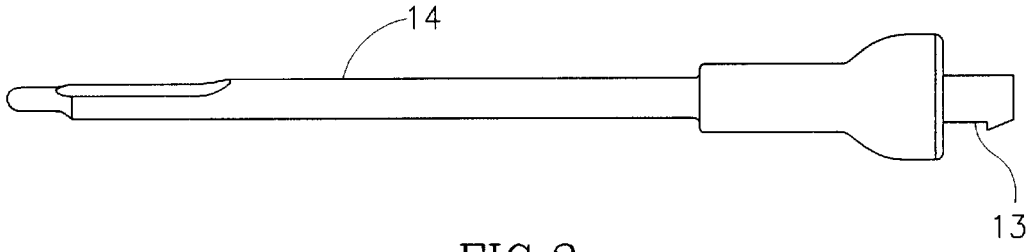
FIG. 3 is a schematic plan view of a firing pin in the safety mechanism of FIG. 1.

FIG. 2 is a perspective illustration of a firing pin plate 16 constructed and operative in accordance with one embodiment of the invention. In this embodiment, a planar groove 20, with a recess 21 for the blocking spring, is created in the middle of the firing pin plate 16, so that a looped blocking spring 22 (seen in detail in FIGS. 4 and 5) can be mounted therein. Firing pin plate 16 includes a throughgoing bore 23, through which the end of the firing pin protrudes when the firearm is assembled. Blocking spring 22 is arranged to move into and out of bore 23 during operation of the safety mechanism. In order to permit locking of the firing pin 14, a locking notch 13 is defined in the end thereof which extends through bore 23 in firing pin plate 16, as shown in FIG. 3, a perspective illustration of a firing pin according to one embodiment of the invention.

Figure 4:
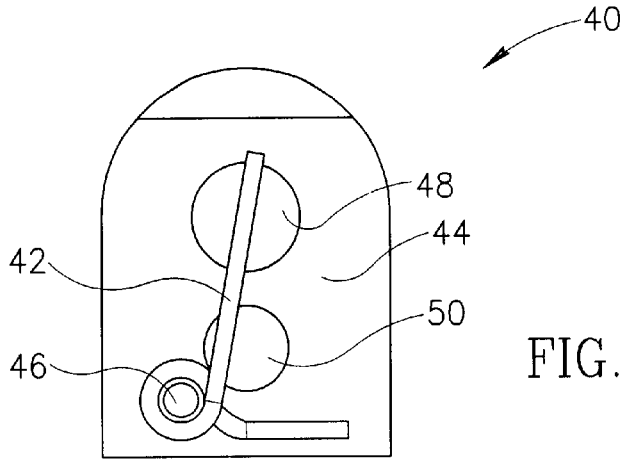
FIG. 4 is a schematic sectional illustration of a safety mechanism according to the present invention in a locking orientation.
Figure 5:
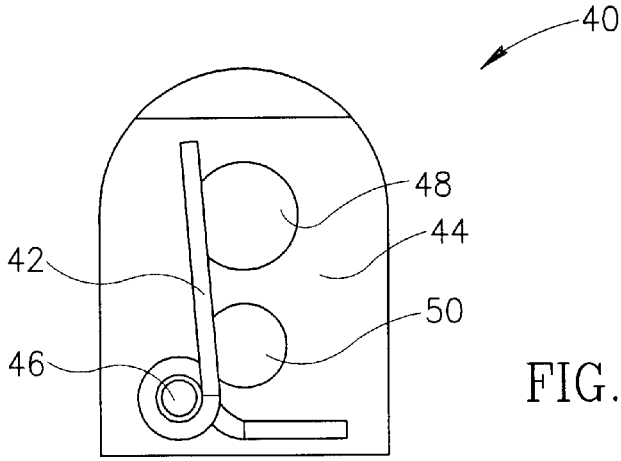
FIG. 5 is a schematic sectional illustration of the safety mechanism of FIG. 4 in a firing orientation.
Figure 6:
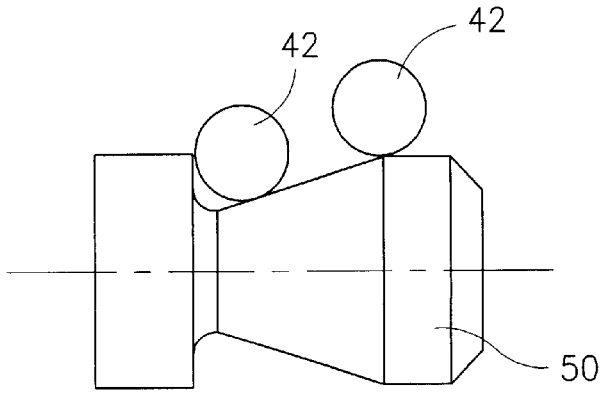
FIG. 6 is a side view of a plunger in the safety mechanism of FIG. 4, showing schematically the locking and firing orientations.

Operation of the safety mechanism of the present invention will now be described with reference to FIGS. 4, 5 and 6. Referring to FIG. 4, there is shown a schematic sectional illustration of a safety mechanism 40 according to one embodiment of the invention in a locking orientation. As can be seen, a blocking spring 42 is mounted in a firing pin plate 44 and fixed at 46, as by a retaining pin. Blocking spring 42 engages a plunger 50, shown in detail in FIG. 6. As can be seen, plunger 50 is conical in shape. When blocking spring 42 is mounted in firing pin plate 44, it contacts and can slide along the side of the plunger 50. Thus, in the locking orientation of FIG. 4, blocking spring 42 seats on the smaller diameter portion of plunger 50, so that the blocking spring 42 partially blocks firing pin receiving bore 48 in the firing pin plate. When a firing pin is seated in bore 48, spring 42 extends into the bore and engages the notch 13 on the end of the firing pin (seen in FIG. 3). Thus, even if the firearm is dropped on its muzzle, the firing pin is held in place in the firing pin plate by the blocking spring 42. It will be appreciated that the default orientation is the locked orientation, with blocking spring 42 engaging notch 13 of the firing pin.

When it is desired to fire the firearm, the hammer hits first the plunger 50 and then the firing pin. When plunger 50 is pushed into firing pin plate 44 against the action of the plunger spring, as seen in FIG. 5, the blocking spring slides along the conical plunger 50 as the diameter increases, which forces the spring out of bore 48 to a firing orientation 42' (see also FIG. 6). As the blocking spring moves out of bore 48 to the firing orientation 42', the locking notch in the firing pin is released by the locking spring. Now, when it is hit by the hammer, the firing pin is free to move to fire a cartridge. Thus, plunger 50 serves as a release element, which acts to release the blocking spring in order to permit firing of the firearm.

While the invention has been described with regard to a particular embodiment, it will be appreciated that any locking element or mechanical mechanism, with any release element, which releasably engages the firing pin upon contact with the hammer above a pre-determined threshold, can alternatively be utilized.

It will be further appreciated that the invention is not limited to what has been described hereinabove merely by way of example. Rather, the invention is limited solely by the claims which follow.

That which is claimed:

1. A safety mechanism for a handgun having a pivotal hammer arranged to activate a firing pin, the mechanism comprising:

a locking element for releasably engaging the firing pin; and a separate release element for releasing said locking element upon being hit by the hammer with a force above a pre-determined threshold, wherein said locking element includes:

a firing pin plate, through which one end of the firing pin passes;

said safety mechanism being formed in said firing pin plate.

2. The safety mechanism according to claim 1, wherein said locking element includes:

a blocking spring in said firing pin plate; and a notch in the firing pin, the blocking spring engaging the notch in a locked orientation, and the blocking spring being out of engagement with the notch in a firing orientation.

3. The safety mechanism according to claim 2, wherein said blocking spring is mounted in a groove cut in the firing pin plate.

4. The safety mechanism according to claim 2, wherein said release element includes a reciprocating plunger engaging said blocking spring, the plunger being located so as to be hit by the hammer just before the hammer hits the end of the firing pin.

5. The safety mechanism according to claim 3, wherein said release element includes a reciprocating plunger engaging said blocking spring, the plunger being located so as to be hit by the hammer just before the hammer hits the end of the pin.

6. The safety mechanism according to claim 4, wherein said plunger has a conical cross section, the blocking spring being located so as to slide along the plunger when moving from the locked to the firing orientation.

7. The safety mechanism according to claim 5, wherein said plunger has a conical cross section, the blocking spring being located so as to slide along the plunger when moving from the locked to the firing orientation.

8. The safety mechanism of claim 4, further comprising a plunger spring for returning said plunger from the firing to the locked orientation.

9. The safety mechanism according to claim 2, wherein the hammer is arranged to hit both the release element and the firing pin, the hitting of the release element causing release of the blocking spring so that the firing pin is in the firing orientation.

10. The safety mechanism according to claim 5, wherein the hammer is arranged to hit both the plunger and the firing pin, the hitting of the plunger causing release of the blocking spring so that the firing pin is in the firing orientation.

11. A method of preventing inadvertent firing of a firearm having a firing pin seated in a firing pin block and a hammer for actuating the firing pin, the method comprising:

mounting a locking element in the firing pin block;

mounting a separate release element, coupled to said locking element, in the firing pin block; and releasably engaging the firing pin by said locking element;

said locking element being released upon the release element being hit by the hammer with a force above a pre-determined threshold.

12. The method according to claim 11, wherein said step of releasably engaging the firing pin includes:

forming a notch in the firing pin;

mounting a blocking spring in the firing pin block located so as to releasably engage said notch in the firing pin; and mounting a plunger in the firing pin block in slideable engagement with said blocking spring, for moving said blocking spring from a locking orientation to a firing orientation.

13. The method according to claim 12, further comprising automatically returning said blocking pin from said firing orientation to said locking orientation after firing.

* * * * *